US006408475B1

(12) United States Patent
Morrison

(10) Patent No.: US 6,408,475 B1
(45) Date of Patent: Jun. 25, 2002

(54) SELF CLEANING BRUSH

(76) Inventor: Mark D. Morrison, 666 W. Endave, 193 Apt., New York, NY (US) 10025

( * ) Notice: Subject to any disclaimer, the term of this patent is extended or adjusted under 35 U.S.C. 154(b) by 0 days.

(21) Appl. No.: 09/661,524

(22) Filed: Sep. 13, 2000

(51) Int. Cl.[7] ..... A46B 17/06
(52) U.S. Cl. ..... 15/159.1; 15/246; 119/628; 132/119
(58) Field of Search ..... 15/159.1, 160, 15/169, 246; 119/628; 132/119

(56) References Cited

U.S. PATENT DOCUMENTS 3,172,139 A * 3/1965 Wire
4,225,997 A 10/1980 Thomas et al.
4,517,703 A 5/1985 Koke
5,600,865 A 2/1997 Morrison
5,603,137 A * 2/1997 Hasan
5,819,758 A 10/1998 Sohler
5,926,902 A 7/1999 Pierre

* cited by examiner

*Primary Examiner*—Terrence R. Till
(74) *Attorney, Agent, or Firm*—Hayes Soloway PC

(57) ABSTRACT

A self-cleaning brush having a sliding cleaning element. The sliding cleaning element is received on the body of the brush such that when the brush becomes fouled with foreign material the cleaning element may slide along the length of the brush body and free any foreign material from the bristles of the brush.

13 Claims, 2 Drawing Sheets

SELF CLEANING BRUSH

FIELD OF THE INVENTION

The present invention pertains to brushes, and more particularly to brushes that are self-cleaning. More particularly, the present invention relates to a self-cleaning styling brush, which contain bristles projecting circumferentially, which style of brush finds particular utility in hair-styling when used in combination with hair dryers and/or related types of styling techniques.

BACKGROUND

A brush, such as a hair brush, tends to pick up foreign material, such as hair, debris, etc., with use. The foreign material tends to foul the brush and to transfer the foreign material during subsequent uses. To prevent this problem the brush must be periodically cleaned such as by using another brush or a comb. This cleaning process is often time-consuming and inconvenient, and furthermore, it is seldom entirely effective.

In consideration of the problem of cleaning a brush, a number of disclosures have been put forward in an attempt to solve this problem. U.S. Pat. No. 6,021,542, to Norman, teaches a self cleaning hair brush that utilizes a plurality of perforated sheets disposed at the base of the bristles. As the bristles become fouled, the top most of the perforated sheets is removed from the brush, therein sweeping the bristles and pulling off any foreign material.

Along a similar line, U.S. Pat. No. 5,600,865, to Morrison, teaches a brush having a removable perforated plate disposed at the base of the bristles. Much the same as the Norman patent, when the brush becomes fouled the perforated plate is removed, therein carrying away any foreign material. Unlike Norman, however, the perforated plate of Morrison is then reattached to the brush by threading the bristles through the perforations and re-securing the perforated plate to the brush.

Along a different line is U.S. Pat. No. 4,225,997, to Thomas, et al. The brush of Thomas accomplishes the cleaning of the brush by retracting the bristles. By the teachings of Thomas, when the brush becomes fouled the bristles are retracted, therein releasing any foreign matter that has become ensnared in the bristles.

SUMMARY

A self cleaning brush comprising a body having a plurality of bristles extending from at least a portion of said body. A cleaning element is slidably disposed on said body, wherein the sliding element contains a plurality of projections which engage with said bristles. The cleaning element projections further define a space between the projections for the bristles to pass as the cleaning element slides along the brushy body. The space is of a size and geometry to engage said bristles and to clean said bristles as said cleaning element slides along said brush body.

In alternative embodiment, the present invention also relates to a self cleaning brush comprising a body having a plurality of bristles extending from at least a portion of said body including grooves positioned between said bristles and a cleaning element slidably disposed on said body, said sliding element containing a plurality of projections which slidably engage within said grooves. The cleaning element projections define a space between the projections for the bristles to pass as said cleaning element slides along said body, wherein said space is of a size and geometry to engage said bristles and to clean said bristles as said cleaning element slides along said brush body.

DESCRIPTION OF THE INVENTION

Figure 1:
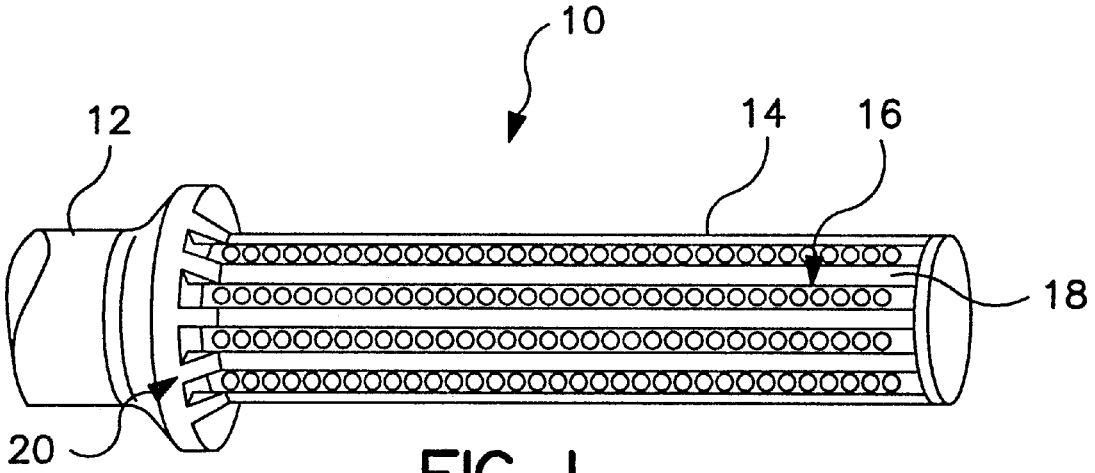
FIG. 1 schematically illustrates an exemplary embodiment of a self-cleaning brush consistent with the present invention, showing only the preferred brush design.
Figure 2:
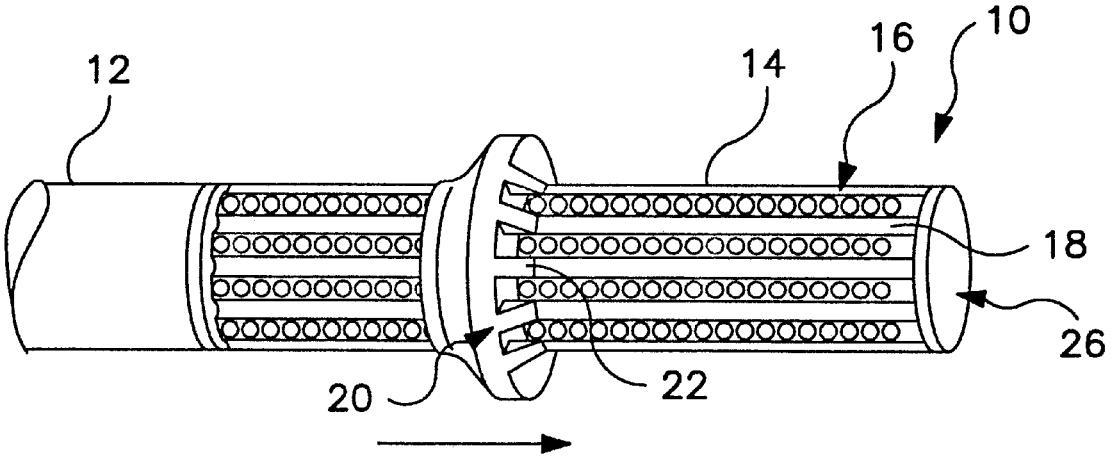
FIG. 2 illustrates the the exemplary brush of FIG. 1, in addition to a cleaning element.

Referring to FIGS. 1 and 2, an exemplary self cleaning brush 10 consistent with the present invention is schematically illustrated. The brush 10 preferably comprises a brush body 14 and a handle 12 extending from the proximal end of the body 14. The handle 12 and the body 14 may preferably be formed as a single unitary piece, or may alternately comprise a plurality of assembled pieces.

Figure 3:
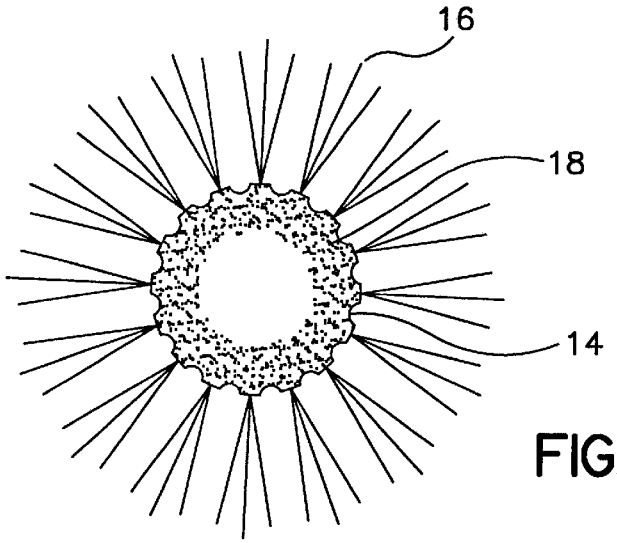
FIG. 3 shows the cross-sectional profile of an exemplary brush body.
Figure 4:
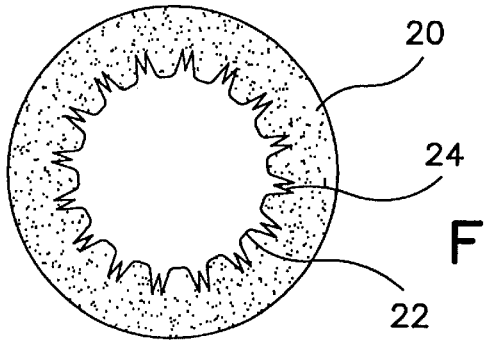
FIG. 4 depicts an exemplary cleaning disc in end view profile.
Figure 5:
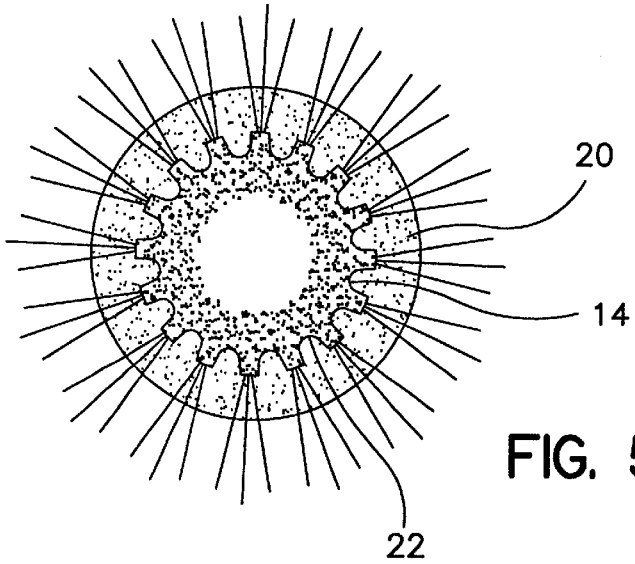
FIG. 5 illustrates the assembled arrangement of the exemplary cleaning disc of FIG. 4 with respect to the exemplary brush body of FIG. 3.

The body 14 of the brush 10 comprises a plurality of bristles 16 extending therefrom. Preferably the bristles 16 are arranged in a plurality of longitudinally oriented rows extending most of the length of the body 14 of the brush 10. As illustrated in FIGS. 1 through 3, the longitudinally oriented rows of bristles 16 are preferably separated by longitudinal grooves 18 in the body 14 of the brush 10.

The self-cleaning brush 10 consistent with the present invention further comprises a cleaning element 20 slidably retained on the body 14 of the brush 10. In the exemplary brush 10, the cleaning element 20 comprises an annular body having an inner diameter configured to receive the body 14 of the brush therethrough. Preferably the cleaning element 20 is secured against axial removal from the body 14 by an end cap 26 having a peripheral dimension greater than the inner diameter of the cleaning member.

The cleaning element 20 preferably comprises radially disposed finger projections 22 disposed on the forward face of the cleaning element 20, i.e. the face opposite the handle 12. Preferably fingers 22 are configured to be aligned with, and ride in the grooves 18 of the brush body 14 when the cleaning element 20 is received on the brush body 14. It is further preferred that the fingers 22 are angled such that the longitudinal extension is greater at the inner diameter of the cleaning element 20 than at the outer diameter.

Furthermore, the finger projections define a space therebetween for the bristles to pass as the cleaning element slides along the brush body. Preferably, the space comprises a plurality of slot elements 24 disposed between each pair of adjacent fingers 22. The slot elements 24 generally comprise an outwardly extending radial notch in the cleaning element 20.

With reference to FIG. 2, the method of operation of the self cleaning brush 10 is illustrated. As the brush 10 is used, the bristles 16 will collect hair and other debris in the bristles 16 themselves, and spanning the space between the rows of bristles 16. The brush 10 is cleaned by sliding the cleaning element 20 axially down the length of the body 14 of the brush 10. As the cleaning element 20 travels down the length of the body 14, the finger projections 22 will remove any hair or debris spanning adjacent rows of bristles 16. The radially outwardly and rearwardly angle of the fingers 22 will force any hair or debris spanning the rows of bristles 16 to be forced away from the bristles and away from the body 14 of the brush. The hair and debris removed from the brush may be transferred to the outer circumference of the cleaning element 20, from where it may be easily removed and discarded.

The cleaning action of the cleaning element 20 as it travels down the length of the body 14 of the brush 10 is further increased by the slot elements 24 disposed on the cleaning element. The notch of slot elements 24 preferably extends outwardly less than the height of the bristles 16. Because of this configuration, as the cleaning element 20 travels down the body 14, the bristles 16 will be caused to deflect toward the distal end of the body 14, i.e., away from the cleaning element 20. This deflection of the bristles 16 will aid in freeing any debris or hair ensnared in the bristles 16 and promote the transfer of any such debris away from the bristles 16 and the body 14 of the brush 10.

While the invention has hereinabove been illustrated and described as having a round body 14 and annular cleaning member 20, this should not be understood to be limiting. The use of alternate configurations are herein contemplated. Alternate configurations may comprise a generally planar body having bristles projecting from either one or both sides. When such a configuration is employed, the cleaning element may comprise a rectangular member having an opening therethrough configured in size and shape to be slidable on the body.

Therefore, while this invention has been disclosed and illustrated with reference to particular embodiments, the principles involved are susceptible for the use in numerous other embodiments. The invention is, therefore, not to be limited by the exemplary embodiments described in detail hereinabove, but only by the claims appended hereto.

What is claimed is:

1. A self cleaning brush comprising:

a body having a plurality of bristles extending from at least a portion of said body;

a cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body.

2. The self cleaning brush of claim 1 wherein said bristles are arranged in a plurality of rows oriented about the longitudinal axis of the body.

3. The self cleaning brush of claim 1 wherein said body comprises longitudinal grooves disposed between adjacent rows of bristles.

4. The self cleaning brush of claim 1 wherein said cleaning element comprises finger type projections configured to slidably engage in said grooves.

5. The self cleaning brush of claim 1 wherein said cleaning element space is a notch aligned with said rows of bristles.

6. The self cleaning brush of claim 1, wherein said space between said projections further comprises a plurality of slots.

7. The self cleaning brush of claim 1, wherein at least a portion of said body contains grooves positioned between said bristles, and said plurality of projections slidably engage with said grooves.

8. A self cleaning brush comprising:

a body having a plurality of bristles extending from at least a portion of said body;

a cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, wherein said cleaning element space is a notch aligned with said rows of bristles, and said notch has a height that is less than a height of said bristles.

9. A self cleaning brush comprising:

a body having a plurality of bristles extending from at least a portion of said body;

a cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, said body further comprising an end cap configured to prevent sliding removal of said cleaning element from said body.

10. A self cleaning brush comprising:

a body having a plurality of bristles extending from at least a portion of said body;

cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, wherein said cleaning element comprises finger type projections configured to slidably engage in said grooves and said fingers are angled upwardly and rearwardly.

11. A self cleaning brush comprising:

a body having a plurality of bristles extending from at least a portion of said body;

a cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, wherein said body is round in profile, and said bristles extend axially from said body.

12. A self cleaning brush comprising:

a body having a plurality of bristles extending from at least a portion of said body;

a cleaning clement slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, wherein said body is round in profile, said bristles extend axially from said body, and said cleaning element is annular in profile.

13. A self cleaning brush comprising:

a body having a plurality of bristles extending from at least a portion of said body;

a cleaning element slidably disposed on said body, said sliding element containing a plurality of projections which engage with said bristles;

said cleaning element projections further defining a space between said projections for said bristles to pass as said cleaning element slides along said body, wherein said space is of a size and geometry to engage said bristles and to clean said bristles as said cleaning element slides along said brush body, wherein said space between said projections further comprises a plurality of slots and said slots comprise an outwardly extending radial notch.

* * * * *

UNITED STATES PATENT AND TRADEMARK OFFICE

CERTIFICATE OF CORRECTION

PATENT NO. : 6,408,475 B1
DATED : June 25, 2002
INVENTOR(S) : Morrison Mark

It is certified that error appears in the above-identified patent and that said Letters Patent is hereby corrected as shown below:

Title page,
Item [76], Inventors, the inventor's address should read
-- 666 West End Ave. Apt.19J --

Signed and Sealed this

Eighteenth Day of May, 2004

JON W. DUDAS
*Acting Director of the United States Patent and Trademark Office*